US011326586B2

(12) United States Patent
Milner et al.

(10) Patent No.: US 11,326,586 B2
(45) Date of Patent: May 10, 2022

(54) EXHAUST COUPLING

(71) Applicant: Edwards Limited, Burgess Hill (GB)

(72) Inventors: Paul Milner, Burgess Hill (GB); David Hayler, Ardingly (GB)

(73) Assignee: Edwards Limited, Burgess Hill (GB)

( * ) Notice: Subject to any disclaimer, the term of this patent is extended or adjusted under 35 U.S.C. 154(b) by 529 days.

(21) Appl. No.: 16/036,053

(22) Filed: Jul. 16, 2018

(65) Prior Publication Data

US 2020/0018301 A1 Jan. 16, 2020

(51) Int. Cl.
*F04B 39/00* (2006.01)

(52) U.S. Cl.
CPC ..... *F04B 39/0061* (2013.01)

(58) Field of Classification Search
CPC ..... F01N 2470/10; F04B 39/0061; F04B 39/0055
See application file for complete search history.

(56) References Cited

U.S. PATENT DOCUMENTS 2,290,818 A 7/1942 Tyskewicz
2,501,751 A 3/1950 Aldridge
2,659,450 A * 11/1953 Baird ..... F01N 1/12 55/396
2,795,374 A * 6/1957 Isakoff ..... F16L 55/04 417/540
3,114,430 A 12/1963 Gallagher
4,111,278 A 9/1978 Bergman
4,192,404 A * 3/1980 Nakagawa ..... F01N 1/083 181/272
4,263,981 A * 4/1981 Weiss ..... F01N 1/02 181/252

(Continued)

FOREIGN PATENT DOCUMENTS

CN 206309551 U 7/2017
EP 0027311 A1 4/1981
JP H11311179 A 11/1999

OTHER PUBLICATIONS

Wikibooks, Acoustics/Car Mufflers, https://en.wikibooks.org/wiki/acoustics/car_mufflers, 3 pages, accessed Jul. 13, 2018.

(Continued)

*Primary Examiner* — Jeremy A Luks
(74) *Attorney, Agent, or Firm* — Theodore M. Magee; Westman, Champlin & Koehler, P.A.

(57) ABSTRACT

An exhaust coupling for a pump is disclosed. The exhaust coupling for a pump, comprises: an inlet chamber defining a coupling inlet for receiving a fluid from said pump; an outlet chamber defining a coupling outlet for outputting said fluid from said exhaust coupling; and a non-linear inter-chamber conduit fluidly coupling said inlet chamber with said outlet chamber for conveying said fluid from said inlet chamber to said outlet chamber. In this way, noise from the pump is abated since it is initially dampened when received in the inlet chamber, then dampened further by the non-linear inter-chamber conduit, before being dampened yet further within the outlet chamber prior to being emitted through the coupling outlet. The presence of the non-linear inter-chamber conduit ensures that there is no direct, linear path along which the noise can travel from the coupling inlet to the coupling outlet.

17 Claims, 2 Drawing Sheets

(56) References Cited

U.S. PATENT DOCUMENTS

| | | | | |
|---|---|---|---|---|
| 4,330,239 | A * | 5/1982 | Gannaway | F01N 1/02 181/272 |
| 4,589,516 | A * | 5/1986 | Inoue | F01N 1/10 181/256 |
| 4,905,790 | A * | 3/1990 | Luszczycki | F04B 39/0055 181/272 |
| 5,196,654 | A * | 3/1993 | DiFlora | F01N 1/083 181/229 |
| 5,635,687 | A * | 6/1997 | Biscaldi | F04B 39/0055 181/272 |
| 6,283,246 | B1 * | 9/2001 | Nishikawa | F01N 1/06 181/255 |
| 7,779,962 | B2 * | 8/2010 | Zhang | F04B 39/0061 181/237 |
| 9,943,661 | B2 * | 4/2018 | Sims | A61M 16/101 |
| 2004/0182643 | A1 | 9/2004 | Toyoshima | |

OTHER PUBLICATIONS

Silex, Exhaust Silencers, http://www.paraglidingteam.nl/PPGTechnics/sound%20and%20noise/Mufflers/Exhaust%20Silencers.pdf, 10 pages, 2002.

Combined Search and Examination Report dated Apr. 5, 2019 for corresponding British application Serial No. GB1816435.0.

* cited by examiner

EXHAUST COUPLING

FIELD OF THE INVENTION

The field of the invention relates to an exhaust coupling for a pump.

BACKGROUND

Rotating machines, such as compressors or pumps, need to be carefully designed and manufactured in order for the moving parts to cooperate with each other accurately to provide efficient pumping. Pumps can be installed in a variety of locations and operated under differing conditions. In some circumstances, the operation of the pump can cause a noise nuisance. Although existing approaches can assist in reducing the noise nuisance, their performance is often inadequate. Accordingly, it is desired to reduce the noise nuisance.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided an exhaust coupling for a pump, comprising: an inlet chamber defining a coupling inlet for receiving a fluid from said pump; an outlet chamber defining a coupling outlet for outputting said fluid from said exhaust coupling; and a non-linear inter-chamber conduit fluidly coupling said inlet chamber with said outlet chamber for conveying said fluid from said inlet chamber to said outlet chamber.

The first aspect recognises that one area of noise nuisance is the noise emitted from an exhaust coupling of the rotating machine, particularly when that exhaust coupling remains uncoupled to downstream conduits such as an exhaust line. Accordingly, an exhaust coupling is provided. The exhaust coupling may be a rotating machine or pump exhaust coupling. The exhaust coupling may comprise an inlet chamber or void which has a coupling inlet which receives a fluid from the pump. The exhaust coupling may comprise an outlet chamber or void which has a coupling outlet which outputs, conveys or provides the fluid from the exhaust coupling. The exhaust coupling may comprise a non-linear, bent or curved inter-chamber conduit. The inter-chamber conduit may fluidly couple or connect the inlet chamber and the outlet chamber. The inter-chamber conduit may convey or transfer the fluid from the inlet chamber to the outlet chamber. In this way, noise from the pump is abated since it is initially dampened when received in the inlet chamber, then dampened further by the non-linear inter-chamber conduit, before being dampened yet further within the outlet chamber prior to being emitted through the coupling outlet. The presence of the non-linear inter-chamber conduit ensures that there is no direct, linear path along which the noise can travel from the coupling inlet to the coupling outlet.

In one embodiment, said inter-chamber conduit comprises at least one bend. Accordingly, the inter-chamber conduit may have one or more bends, turns or corners, each of which helps to attenuate noise and provide a compact arrangement.

In one embodiment, said inter-chamber conduit comprises at least a pair of bends.

In one embodiment, said inter-chamber conduit comprises at least one elongate section positioned between bends. Providing an elongate section between bends helps to separate the bends and vary the resonant frequency of the inter-chamber conduit to help attenuate noise.

In one embodiment, said inter-chamber conduit is U-shaped. A U-shaped inter-chamber conduit is easy to manufacture and install.

In one embodiment, said inter-chamber conduit defines a conduit inlet located within said inlet chamber and a conduit outlet located within said outlet chamber. Accordingly, the conduit inlet may be located at a desired position, longitudinally and/or radially within the inlet chamber, with the conduit outlet also being located at a desired position longitudinally and/or radially within the outlet chamber.

In one embodiment, at least one of said conduit inlet and said conduit outlet is orientated transverse to a longitudinal axis of a respective one of said inlet chamber and said outlet chamber. By positioning the conduit inlet and/or outlet to be other than aligned with the longitudinal axis of the chambers, noise attenuation is improved.

In one embodiment, at least one of said conduit inlet and said conduit outlet is positioned at a distance offset from said longitudinal axis of a respective one of said inlet chamber and said outlet chamber. By locating the conduit inlet and/or the conduit outlet at a position which is offset from the centre line of the chambers provides for different length portions of the inter-chamber conduit to adjust its resonant frequencies and adjusts the noise coupling characteristics between the inlet chamber and the inter-chamber conduit as well as between the outlet chamber and the inter-chamber conduit.

In one embodiment, at least one of said conduit inlet and said conduit outlet is positioned to align with said longitudinal axis of a respective one of said inlet chamber and said outlet chamber.

In one embodiment, said inter-chamber conduit extends through an external wall of said inlet chamber and said outlet chamber. Accordingly, the inter-chamber conduit may be located at least partially outside of the chambers, which assists in manufacturing.

In one embodiment, a cross-sectional area of said inter-chamber conduit is smaller than a cross-sectional area of at least one of said inlet chamber and said outlet chamber. Having a smaller inter-chamber conduit helps to attenuate noise.

In one embodiment, said inlet chamber and said outlet chamber have differing longitudinal lengths. By having different sized chambers, noise coupling between the chambers can be reduced.

In one embodiment, at least one of said coupling inlet and said coupling outlet comprise a flow restrictor. Providing a restrictor on the coupling inlet and/or the coupling outlet helps to attenuate noise.

In one embodiment, a cross-sectional area of each flow restrictor is smaller than a cross-sectional area of a respective one of said inlet chamber and said outlet chamber.

In one embodiment, each flow restrictor is positioned one of aligned and offset from said longitudinal axis of a respective one of said inlet chamber and said outlet chamber. Accordingly, the flow restrictors may be either aligned or offset from the centre line of the chambers in order to improve noise attenuation.

In one embodiment, each flow restrictor has one of differing and matching longitudinal lengths. Accordingly, the flow restrictors may have the same or different longitudinal lengths.

In one embodiment, at least one flow restrictor comprises differing cross-sectional areas along its longitudinal length. Providing a restrictor whose cross-section varies along its length helps to improve noise attenuation.

In one embodiment, at least one flow restrictor comprises an expanding cross-sectional area.

In one embodiment, said exhaust coupling comprises a body defining said inlet chamber separated from said outlet chamber by a divider wall. Accordingly, the inlet chambers may be provided within a unitary body, but partitioned from each other by a dividing or separating wall or body.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DESCRIPTION OF THE EMBODIMENTS

Before discussing the embodiments in any more detail, first an overview will be provided. Embodiments provide an exhaust coupling for a rotating machine. A conventional exhaust coupling may comprise a simple elongate tube which couples with a flange on the rotating machine and has a terminating flange which connects to an exhaust line. In some circumstances, the noise emitted from the exhaust coupling, particularly when no exhaust line is present, can be a nuisance. Embodiments provide an exhaust coupling which attenuates or reduces the noise emitted from the exhaust coupling. At least one pair of chambers is provided within the coupling, which are separated by a dividing wall. It will be appreciated that more than two chambers may be provided, if required. Each pair of chambers is coupled together by an inter-chamber conduit which extends from one chamber to another to enable fluid to be conveyed between the chambers. The inter-chamber conduit which has at least one bend. By providing individual chambers which are only connected using the inter-chamber conduit, which is bent, helps to block the noise path from the inlet of the exhaust coupling to the outlet of the exhaust coupling and attenuates the noise within. The size and number of the chambers, together with the size and positioning of the inter-chamber conduits, can be selected to maximise noise attenuation under expected operating conditions.

Exhaust Coupling

Figure 1:
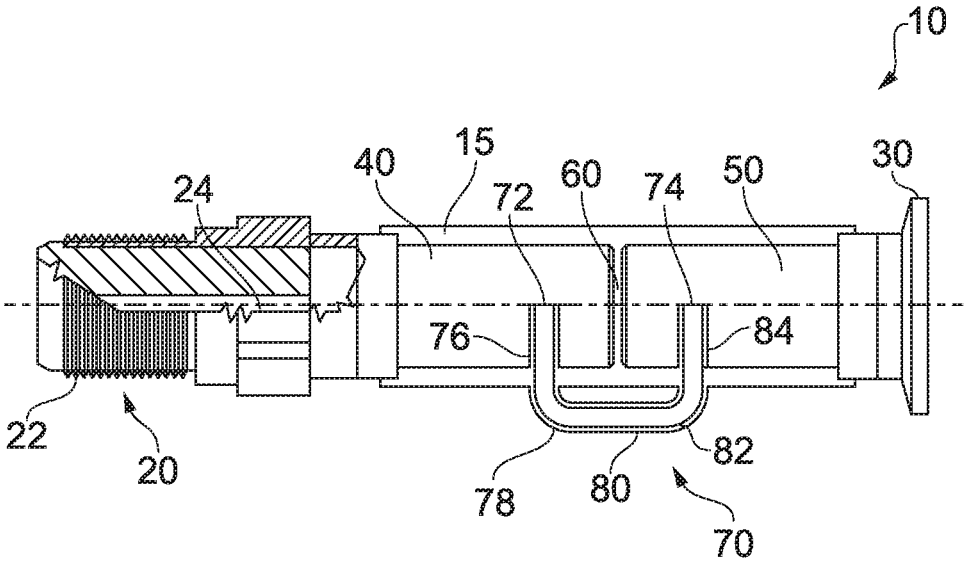
FIG. 1 illustrates an exhaust coupling according to one embodiment.

FIG. 1 illustrates an exhaust coupling 10 according to one embodiment. The exhaust coupling 10 has an inlet connector 20 which is received by an outlet from a pump or other rotating machine (not shown). The inlet connector 20 has a threaded portion 22 which is received within the outlet from the pump. The exhaust coupling 10 has an outlet connector 30 which may couple with an exhaust line or vent straight to atmosphere. The exhaust coupling 10 comprises an elongate tubular body section 15. The inlet connector 20 defines an inlet conduit 24 whose diameter is significantly less than the diameter of the body section 15. In this example, the body section has an internal diameter of 22.5 mm and the inlet conduit 24 has a diameter of 4 mm.

The body section 15 defines an inlet chamber 40 and an outlet chamber 50. The inlet chamber 40 and the outlet chamber 50 are separated by a wall 60. The inlet connector 20 extends along the longitudinal length of the exhaust coupling 10 between the pump and the inlet chamber 40. The inlet chamber 40 extends longitudinally along the longitudinal length of the exhaust coupling 10 between the inlet connector 20 and the dividing wall 60. The dividing wall 60 is positioned between the inlet chamber 40 and the outlet chamber 50. The outlet chamber 50 extends along the longitudinal length between the dividing wall 60 and the outlet connector 30. The outlet connector 30 extends longitudinally and may be connected to an exhaust line or remain unconnected.

An inter-chamber conduit 70 extends between the inlet chamber 40 and the outlet chamber 50. The inter-chamber conduit 70 has a conduit inlet 72 located within the inlet chamber 40 and a conduit outlet 74 located within the outlet chamber 50. The inter-chamber conduit 70 is U-shaped and has a first linear portion 76 extending from the conduit inlet 70 to a first bend 78. A second linear portion 80 extends from the first bend 78 to a second bend 82. A third linear portion 84 extends from the second bend 82 to the conduit outlet 74. The internal diameter of the inter-chamber conduit 70 is also significantly smaller than the internal diameter of the inlet chamber 40 and the outlet chamber 50. The first linear portion 76 extends through the wall of the body section 15 and into the inlet chamber 40 in a direction which is perpendicular to the longitudinal axis of the exhaust coupling 10. The third linear portion 84 also extends through the wall of the body section 15 and into the outlet chamber 50 in a direction perpendicular to the elongate axis of the exhaust coupling 10. The second linear portion 80 extends generally parallel to the outer surface of the body section 15. In this example, the internal diameter of the inter-chamber conduit 70 is 4 mm.

In operation, the fluid from the pump is received by the inlet conduit 24 and passes into the inlet chamber 40. Fluid received within the inlet chamber 40 enters the conduit inlet 74, travels through the first linear portion 76, around the first bend 78, along the second linear portion 80, around the second bend 82, along the third linear portion 84, out of the conduit outlet 74 and into the outlet chamber 50. The fluid then passes from the outlet chamber 50 through the outlet connector 30.

Figures 2A, 2B, 2C, 2D, 2E, 2F:
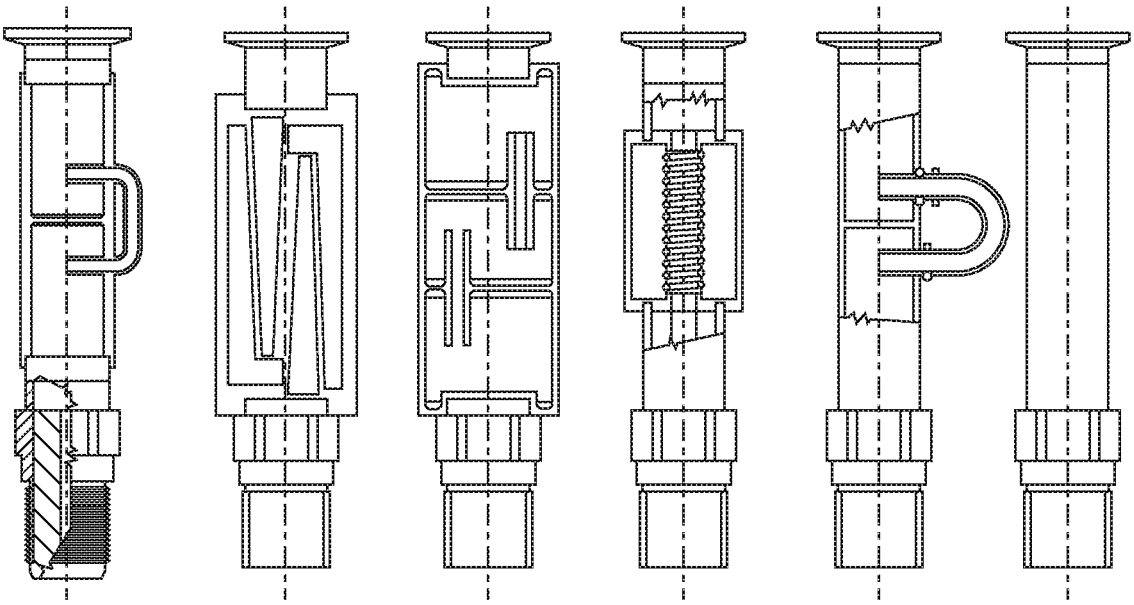
FIGS. 2A to 2F show alternative arrangements of exhaust couplings.

The presence of the restriction caused by the reduced diameter of the inlet conduit 24, the presence of the dividing wall 60 between the inlet chamber 40 and the outlet chamber 50, together with the restriction and changes in fluid flow direction caused by the inter-chamber conduit 70, dramatically reduces noise emission from the exhaust coupling 10 compared to a conventional exhaust coupling, as illustrated in FIG. 2F which has a straight-through bore.

FIGS. 2A to 2F show alternative arrangements of exhaust couplings. FIG. 2A shows the arrangement shown in FIG. 1. FIG. 2B shows a dual-tapered arrangement where the fluid is received into a narrowing, tapered conduit, which conveys the fluid into a chamber from which it exits via an expanding, tapered conduit. FIG. 2C shows a three chamber arrangement with straight axially-offset inter-stage couplings. FIG. 2D shows an arrangement with a baffled conduit. FIG. 2E is similar to that of FIG. 1 but has a purely rounded inter-chamber conduit with a larger, 6 mm internal diameter cross-section.

Table 1 provides noise test results (in dB) of the different arrangements described above.

TABLE 1

| Figure (inter-stage conduit internal diameter) | | | | | | | | |
|---|---|---|---|---|---|---|---|---|
| 2F | 2E | 2D | 2C | 2B | 1, 2A (4 mm) | 1, 2A (5 mm) | 1, 2A (6 mm) | Restrictor configuration |
| 85.2 | | | | | | | | No Restrictor |
| 79.7 | 37.0 | 67.9 | 67.6 | 65.8 | 61.5 | | | 4 mm Dia Hole Restrictor |
| | | | | | 66.4 | 65.9 | | 5 mm Dia Hole Restrictor |
| | | 74.0 | 68.7 | 69.1 | | | 67.7 | 6 mm Dia Hole Restrictor |
| | | 74.9 | 66.2 | 67.9 | | | | 8 mm Dia Hole Restrictor |

As can be seen, the conventional exhaust coupling (FIG. 2F) under a 15 millibar load emits 85.2 dB. However, the arrangement shown in FIG. 1, with the 4 mm restrictor and a 4 mm internal diameter inter-stage conduit, emits 61.5 dB, which is a 23.7 dB improvement.

Figure 3:
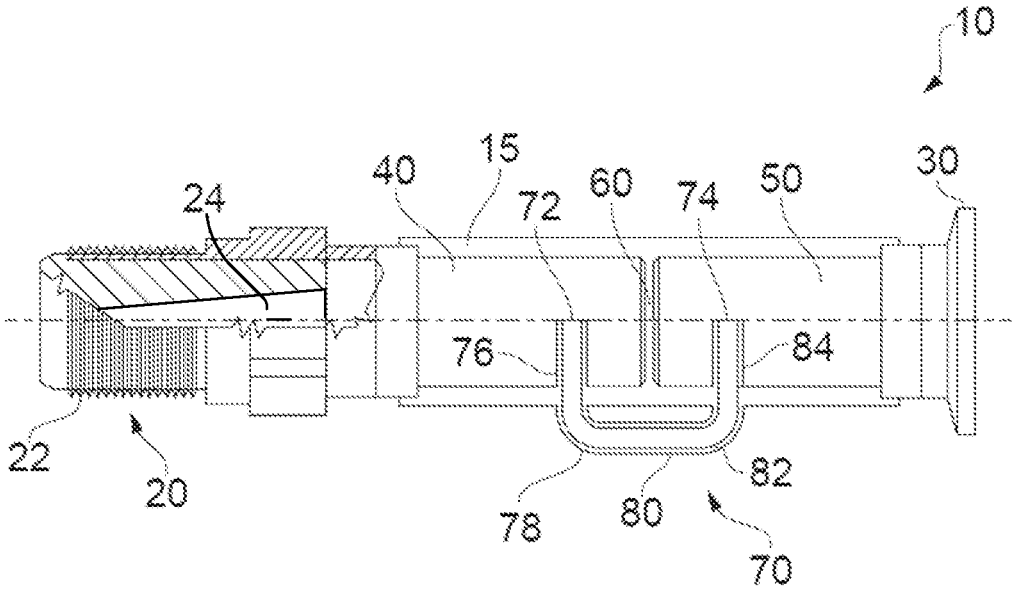
FIG. 3 provides a sectional view of an exhaust coupling of a further embodiment.
Figure 4:
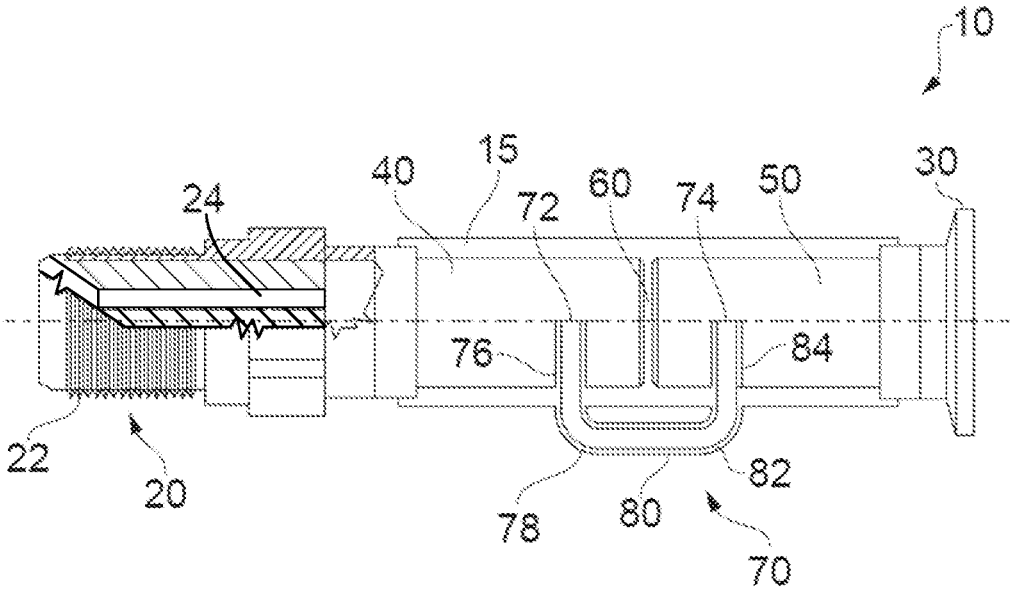
FIG. 4 provides a sectional view of an exhaust coupling of a further embodiment.

Although the embodiment shown in FIG. 1 has a restrictor on the inlet, in one embodiment, a restrictor is also provided on the outlet. Also, in one embodiment the restrictor is of non-uniform cross-section. In particular, as shown in FIG. 3, the internal cross-section of inlet conduit 24 increases along the longitudinal length of the restrictor. In one embodiment, as shown in FIG. 4, the inlet conduit 24 need not be aligned with the centre line of the exhaust coupling 10 but may be offset. In one embodiment, the inlet conduit 72 and/or the outlet conduit 74 are also not aligned with the centre line of the exhaust coupling 10 but are instead offset. In one embodiment, an outlet conduit of the outlet connector 30 is also not aligned with the centre line of the exhaust coupling 10 but is instead offset.

Accordingly, an embodiment provides a bypass silencer exhaust pipe. This reduces exhaust noise when not connected to an exhaust line (running in atmosphere). The arrangement attenuates the emitted sound from the close coupled exhaust running at 15 mb to a level where the pump can be run unconnected to a backing line at atmosphere. As the pump runs at very low flow it was decided that a baffle design should be effectively rerouting the exhaust flow enabling sound to be trapped within the pipe voids. The tube bore is effectively split in two and blocked off using a disc-like wall in the position shown. This would mean a flow bypass is required of a smaller bore than the original pipe and has at least 1×180 degree bend in the flow to negotiate the blockage. Many pipe diameters and pitches were tried to tune for the best noise reduction. The threaded end of the pipe was subsequently restricted also to form what is effectively a third volume connected with pipes and this help to lower the frequency to the level we required. The effective noise reduction of the finished pipe is around 20+dB. A complication of having to fit into a tightly restrictive area and be able to be rotated on assembly lead to the lower profile pipe bend extending past the tube surface. The optimal connecting pipe diameter for one implementation is 4 mm, performance testing has been performed and ultimate pressure is not affected and power is not increased. The arrangement comprises a pump connection thread, a restricted gas inlet to pipe (may consist of 1 or more holes), a bypass inlet, a baffle plate to block pipe flow, a bypass outlet, gas expansion voids (either side of baffle plate), a vacuum connection (e.g. NW25) and a bypass Pipe (size dependant on required flow). The bypass pipe comes externally of the main pipe outside diameter making it much easier to assembly and weld in place and also creates a full 180 degree bend which aids noise attenuation alongside two expansion chambers.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above.

The invention claimed is:

1. An exhaust coupling for a pump, comprising:

a body having an outer surface;

an inlet connector having a threaded portion for threading into an outlet of the pump and an inlet conduit acting as a flow restrictor;

an inlet chamber within the body defining a coupling inlet for receiving a fluid from said pump through said inlet connector;

an outlet chamber within the body defining a coupling outlet for outputting said fluid from said exhaust coupling;

a barrier between the inlet chamber and the outlet chamber that prevents fluid from passing across the barrier within the body; and a non-linear inter-chamber conduit fluidly coupling said inlet chamber with said outlet chamber for conveying said fluid from said inlet chamber to said outlet chamber, said conduit extending outside of the outer surface of said body.

2. The exhaust coupling of claim 1, wherein said inter-chamber conduit comprises at least one bend.

3. The exhaust coupling of claim 1, wherein said inter-chamber conduit comprises at least a pair of bends.

4. The exhaust coupling of claim 2, wherein said inter-chamber conduit comprises at least one elongate section positioned between bends.

5. The exhaust coupling of claim 1, wherein said inter-chamber conduit is U-shaped.

6. The exhaust coupling of claim 1, wherein said inter-chamber conduit defines a conduit inlet located within said inlet chamber and a conduit outlet located within said outlet chamber.

7. The exhaust coupling of claim 6, wherein at least one of said conduit inlet and said conduit outlet is orientated transverse to a longitudinal axis of a respective one of said inlet chamber and said outlet chamber.

8. The exhaust coupling of claim 7, wherein at least one of said conduit inlet and said conduit outlet is positioned at a distance offset from said longitudinal axis of a respective one of said inlet chamber and said outlet chamber.

9. The exhaust coupling of claim 7, wherein at least one of said conduit inlet and said conduit outlet is positioned to align with said longitudinal axis of a respective one of said inlet chamber and said outlet chamber.

10. The exhaust coupling of claim 1, wherein said inter-chamber conduit extends through an external wall of said inlet chamber and said outlet chamber.

11. The exhaust coupling of claim 1, wherein a cross-sectional area of said inter- chamber conduit is smaller than a cross-sectional area of at least one of said inlet chamber and said outlet chamber.

12. The exhaust coupling of claim 1, wherein said inlet chamber and said outlet chamber have differing longitudinal lengths.

13. The exhaust coupling of claim 1, wherein a cross-sectional area of the inlet conduit is smaller than a cross-sectional area of said inlet chamber.

14. The exhaust coupling of claim 1, wherein the inlet conduit is positioned offset from a longitudinal axis of said inlet chamber.

15. The exhaust coupling of claim 1, wherein different portions of the inlet conduit have different cross-sectional areas.

16. The exhaust coupling of claim 1, wherein the inlet conduit has an expanding cross-sectional area.

17. An exhaust coupling for a pump, comprising:

a body having an outer surface;

an inlet connector having a threaded portion for threading into an outlet of the pump;

an inlet chamber within the body defining a coupling inlet for receiving a fluid from said pump through said inlet connector;

an outlet chamber within the body defining a coupling outlet for outputting said fluid from said exhaust coupling;

a wall between the inlet chamber and the outlet chamber that prevents fluid from passing across the wall within the body; and a non-linear inter-chamber conduit fluidly coupling said inlet chamber with said outlet chamber for conveying said fluid from said inlet chamber to said outlet chamber, said conduit extending outside of the outer surface of said body wherein said inter-chamber conduit defines a conduit inlet located within said inlet chamber and a conduit outlet located within said outlet chamber and at least one of said conduit inlet and said conduit outlet is orientated transverse to a longitudinal axis of a respective one of said inlet chamber and said outlet chamber.

* * * * *